US009940879B2

(12) United States Patent
Gettemy et al.

(10) Patent No.: US 9,940,879 B2
(45) Date of Patent: Apr. 10, 2018

(54) WHITE POINT UNIFORMITY TECHNIQUES FOR DISPLAYS

(75) Inventors: Shawn Robert Gettemy, San Jose, CA (US); Joshua Grey Wurzel, Sunnyvale, CA (US); Jean-Pierre Simon Guillou, San Francisco, CA (US); Ming Xu, Cupertino, CA (US); David Andrew Doyle, San Francisco, CA (US)

(73) Assignee: APPLE INC., Santa Clara, CA (US)

( * ) Notice: Subject to any disclaimer, the term of this patent is extended or adjusted under 35 U.S.C. 154(b) by 1415 days.

(21) Appl. No.: 13/253,739

(22) Filed: Oct. 5, 2011

(65) Prior Publication Data

US 2013/0088522 A1 Apr. 11, 2013

(51) Int. Cl.
*G09G 3/36* (2006.01)
*G09G 3/34* (2006.01)

(52) U.S. Cl.
CPC ... *G09G 3/3406* (2013.01); *G09G 2320/0646* (2013.01); *G09G 2320/0666* (2013.01); *G09G 2360/145* (2013.01)

(58) Field of Classification Search
CPC ..... G09G 3/3406; G09G 2320/0646; G09G 2320/0666; G09G 2360/145
USPC ..... 345/690, 102
See application file for complete search history.

(56) References Cited

U.S. PATENT DOCUMENTS 6,285,344 B1 9/2001 Everard et al.
6,630,801 B2 10/2003 Schuurmans
6,636,003 B2 10/2003 Rahm et al.
6,693,394 B1 2/2004 Guo et al.
6,933,967 B2 8/2005 Doyle et al.
7,002,546 B1 * 2/2006 Stuppi et al. ..... 345/102
7,119,500 B2 10/2006 Young
7,312,779 B1 * 12/2007 Blevins ..... 345/102
7,671,542 B2 3/2010 Chang et al.
8,711,081 B2 4/2014 Yang et al.
8,850,714 B2 * 10/2014 Matsui ..... 34/179
2007/0141732 A1 6/2007 Huang et al.
(Continued)

FOREIGN PATENT DOCUMENTS

TW 200921596 A 5/2009
TW 201037656 A 10/2010

OTHER PUBLICATIONS

International Search Report and Written Opinion for PCT No. PCT/US2012/057080 dated Dec. 18, 2012; 12 pages.
(Continued)

*Primary Examiner* — Benyam Ketema
(74) *Attorney, Agent, or Firm* — Fletcher Yoder PC

(57) ABSTRACT

The present disclosure generally relates to systems and techniques for calibrating displays to improve the white point uniformity between similar type devices. In one embodiment, a backlight includes multiple strings of LEDs, where each string is driven by a separate driver, or driver channel. Each string may be separately tested at a base current to determine its emitted chromaticity, and values indicative of the emitted chromaticities may be stored within the backlight as calibration values. The calibration values may then be used to determine the driving strength for each string that allows the display to produce the target white point when the light from the strings is mixed. Further, in certain embodiments, adjustments also may be made to the LCD panel based on the emitted chromaticities at the base current.

3 Claims, 8 Drawing Sheets

(56) References Cited

U.S. PATENT DOCUMENTS

| | | | | |
|---|---|---|---|---|
| 2008/0062139 | A1 | 3/2008 | Hotelling et al. | |
| 2008/0062140 | A1 | 3/2008 | Hotelling et al. | |
| 2008/0088647 | A1 | 4/2008 | Marcu et al. | |
| 2008/0121898 | A1 | 5/2008 | Yin et al. | |
| 2008/0151527 | A1 | 6/2008 | Ueno et al. | |
| 2008/0204431 | A1 | 8/2008 | Chung et al. | |
| 2008/0309627 | A1 | 12/2008 | Hotelling et al. | |
| 2008/0309633 | A1 | 12/2008 | Hotelling et al. | |
| 2008/0316222 | A1 | 12/2008 | Marcu et al. | |
| 2009/0002311 | A1 | 1/2009 | Barnhoefer et al. | |
| 2009/0002401 | A1 | 1/2009 | Barnhoefer et al. | |
| 2009/0002402 | A1 | 1/2009 | Barnhoefer et al. | |
| 2009/0002403 | A1 | 1/2009 | Barnhoefer et al. | |
| 2009/0002404 | A1 | 1/2009 | Barnhoefer et al. | |
| 2009/0002555 | A1 | 1/2009 | Barnhoefer et al. | |
| 2009/0002560 | A1 | 1/2009 | Barnhoefer et al. | |
| 2009/0002561 | A1 | 1/2009 | Barnhoefer et al. | |
| 2009/0002563 | A1 | 1/2009 | Barnhoefer et al. | |
| 2009/0002564 | A1 | 1/2009 | Barnhoefer et al. | |
| 2009/0002565 | A1 | 1/2009 | Barnhoefer et al. | |
| 2009/0002785 | A1 | 1/2009 | Marcu et al. | |
| 2009/0009442 | A1 | 1/2009 | Galbraith, Jr. et al. | |
| 2009/0128578 | A1 | 5/2009 | Feng | |
| 2010/0110098 | A1* | 5/2010 | Wang | 345/589 |
| 2010/0118057 | A1* | 5/2010 | Atkins et al. | 345/690 |
| 2010/0277410 | A1* | 11/2010 | You et al. | 345/102 |
| 2010/0320928 | A1 | 12/2010 | Kaihotsu et al. | |

OTHER PUBLICATIONS

Office Action for Taiwan Application No. 10136085 dated Jan. 28 2015; 13 pgs.

* cited by examiner

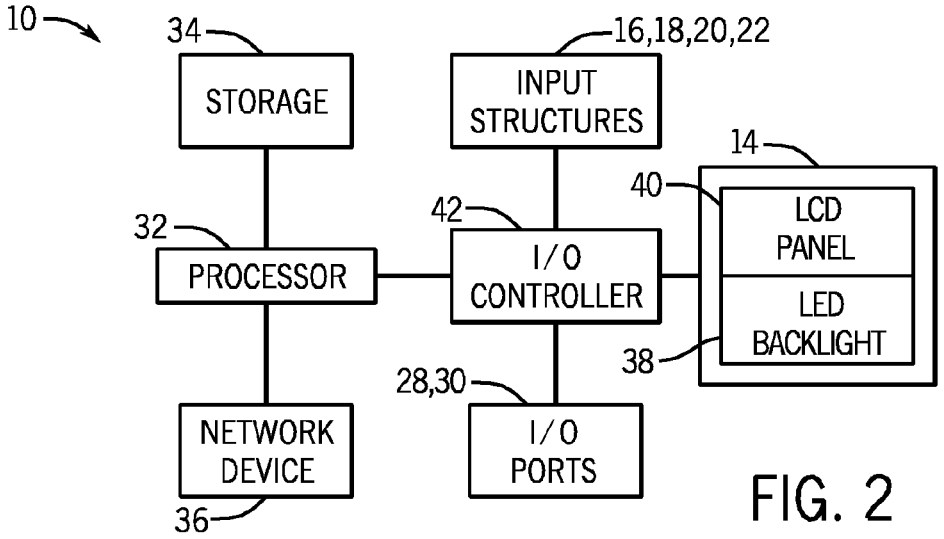
FIG. 2
FIG. 3
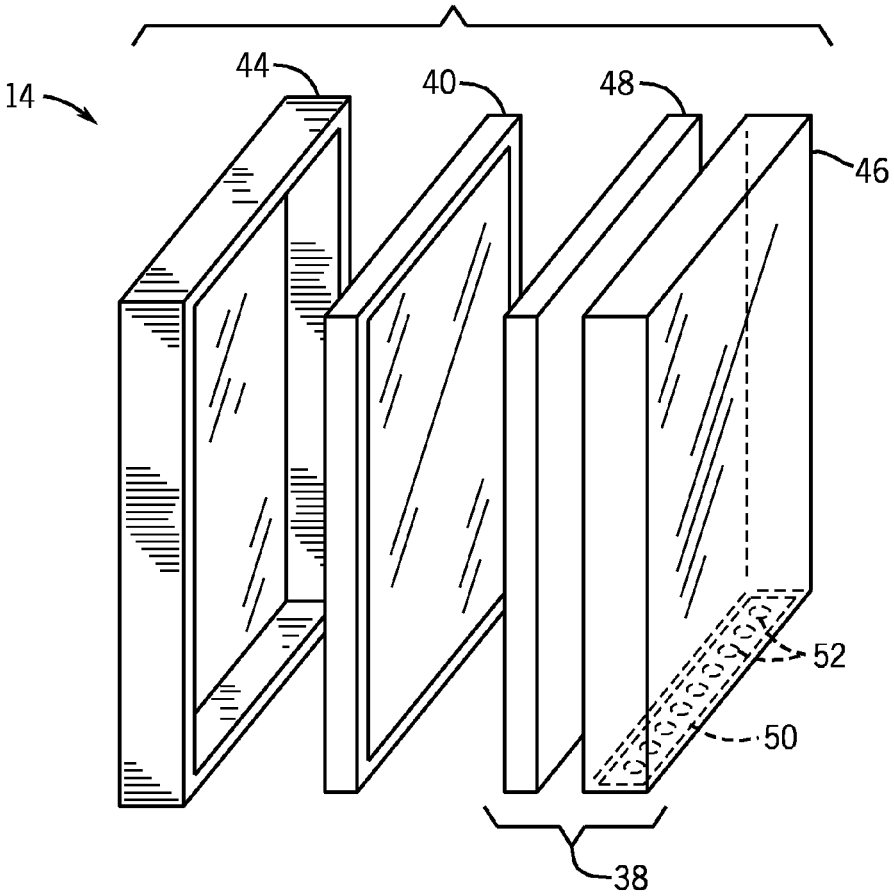

WHITE POINT UNIFORMITY TECHNIQUES FOR DISPLAYS

BACKGROUND

The present disclosure relates generally to displays, and more particularly to displays employing light emitting diode based backlights.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Liquid crystal displays (LCDs) are commonly used as screens or displays for a wide variety of electronic devices, including portable and desktop computers, televisions, and handheld devices, such as cellular telephones, personal data assistants, and media players. Traditionally, LCDs have employed cold cathode fluorescent light (CCFL) light sources as backlights. However, advances in light emitting diode (LED) technology, such as improvements in brightness, energy efficiency, color range, life expectancy, durability, robustness, and continual reductions in cost, have made LED backlights a popular choice for replacing CCFL light sources. However, while a single CCFL can light an entire display; multiple LEDs are typically used to light comparable displays.

Numerous white LEDs may be employed within a backlight. Depending on manufacturing precision, the light produced by the individual white LEDs may have a broad color or chromaticity distribution, for example, ranging from a blue tint to a yellow tint or from a green tint to a purple tint. During manufacturing, the LEDs may be classified into bins with each bin representing a small range of chromaticity values emitted by the LEDs. Within each backlight, LEDs may be selected to produce the target white point. However, due to the range of chromaticity values emitted by LEDs, even by those within the same bin, the white points emitted by different displays may vary. Further, other display components, such as the diffuser plate and thin film transistor layers, can magnify variations in the chromaticity values emitted by the LEDs, and further, can shift the white points emitted by displays. Accordingly, users may perceive variations in the color of different displays. These variations may be particularly noticeable in the displays of handheld devices, such as portable media players and cellular phones, which are frequently exchanged between users or viewed in close proximity to one another.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates generally to techniques for calibrating displays to produce a target white point. Displays used in similar devices each may be calibrated to the target white point to promote uniformity in the appearance of device displays. In accordance with disclosed embodiments, a display may include an LED backlight that has multiple strings of LEDs, with each string including LEDs from a different bin. Each of the strings may be separately tested at a base current, such as 20 mA, to determine the emitted chromaticity of the string. The emitted chromaticity values for each string may be stored as calibration values within the display, and then subsequently used to determine driving strengths for the LED strings. For example, an LED controller for the backlight may compare the calibration values to the target white point and then determine the driving strength for each string that allows the display to produce the target white point when the light from the strings is mixed.

Further, in certain embodiments, one or more adjustments also may be made to the LCD panel included in the display. For example, in certain embodiments, the driving strength adjustments may not be sufficient to align the emitted white point with the target white point. In these embodiments, hardware and/or software adjustments may be employed in the LCD panel to compensate for the deviation between the emitted white point and the target white point. For example, the pixels may be adjusted, or a color mask may be shaped, to shift the overall chromaticity emitted by the display in the green, blue, and/or red direction. In another example, the voltages provided to certain pixels may be adjusted to shift the overall chromaticity emitted by the display in the green, blue, and/or red direction.

BRIEF DESCRIPTION OF THE DRAWINGS

Various aspects of this disclosure may be better understood upon reading the following detailed description and upon reference to the drawings in which:

FIG. 2 is a block diagram of an example of components of the electronic device of FIG. 1, in accordance with aspects of the present disclosure;

FIG. 3 is an exploded view of the LCD display of FIG. 2, in accordance with aspects of the present disclosure;

DETAILED DESCRIPTION OF SPECIFIC EMBODIMENTS

Figure 1:
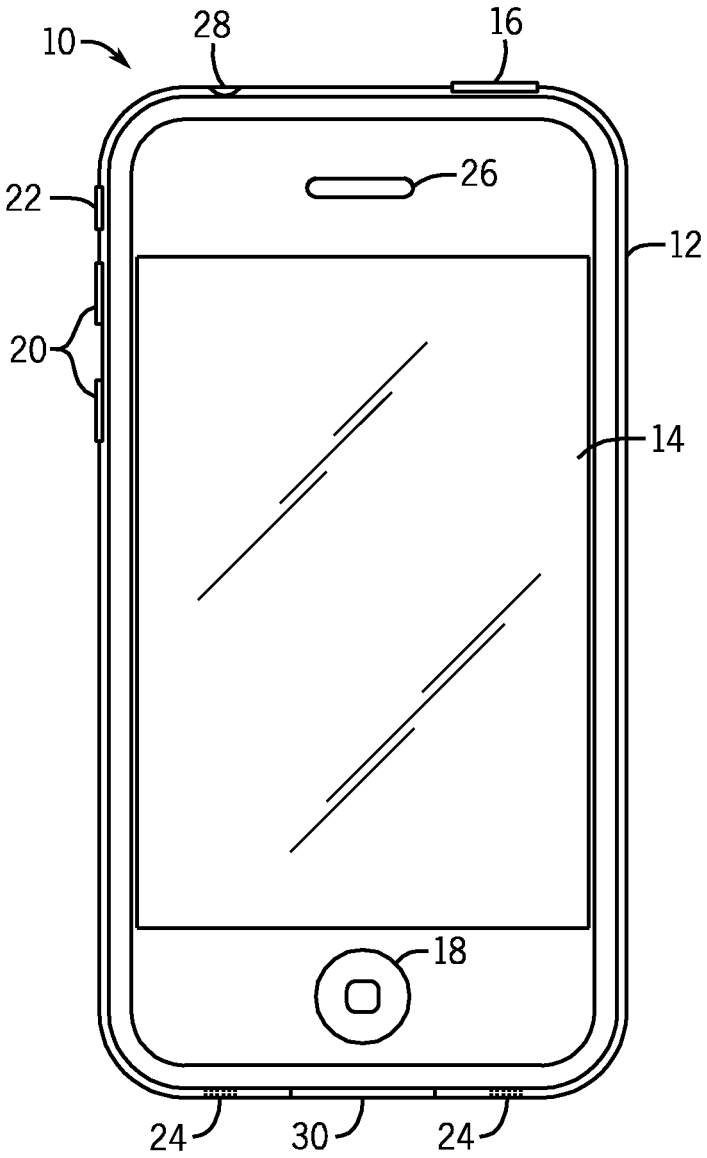
FIG. 1 is a front view of an example of an electronic device employing an LCD display with an LED backlight, in accordance with aspects of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present disclosure is directed to techniques for producing a consistent white point on displays used in different devices. In particular, the present techniques are designed to enable displays on similar devices (e.g., devices of the same model or type) to emit a consistent white point so that the displays appear to have an identical, or substantially identical color and brightness, as observed by a user. According to certain embodiments, the uniform white point may be determined and then set as the target white point for displays used in similar devices.

The displays may each include an LED backlight that illuminates the display using multiple strings of LEDs, with each string including LEDs from a different color bin. Accordingly, each string within an LED backlight may have a different chromaticity. The strings may be selected to have complementary chromaticities, so that when light from the strings is mixed together, a white point that is fairly close to the target white point is emitted. Each of the strings may be separately tested at a base current, such as 20 mA, to determine the emitted chromaticity of the string. Values indicative of the emitted chromaticities may then be stored within the display as calibration values. For example, in certain embodiments, the chromaticity coordinates for each string may be stored as calibration values. The calibration values can then be used during operation of the backlight to determine driving strengths for the LED strings. Each string may be controlled independently by separate driver, or driver channel, which in turn allows each string to be operated at a separate driving strength to fine-tune the white point of the display to the target white point. In particular, control logic within the display may be used to determine the driving strength for each string that aligns the emitted white point with the target white point.

In certain embodiments, the driving strength adjustments may not be sufficient to align the emitted white point with the target white point. In these embodiments, adjustments also may be made to the LCD panel to compensate for the deviation from the target white point so that the overall chromaticity emitted by the display matches a target chromaticity. For example, in certain embodiments, the voltage applied to pixels in the LCD panel may be adjusted to shift the overall chromaticity in the green, blue, and/or red direction. In another example, hardware modifications, such as shaping a color mask or adjusting the number or size of pixels, may be employed to shift the overall chromaticity.

FIG. 1 illustrates an electronic device 10 that may make use of the white point adjustment techniques described above. It should be noted that while the techniques will be described below in reference to illustrated electronic device 10 (which may be a mobile phone), the techniques described herein are usable with any electronic device employing an LED backlight. For example, other electronic devices may include a desktop computer, a laptop computer, a tablet computer, a viewable media player, a personal data organizer, a workstation, a standalone display, or the like. In certain embodiments, the electronic device may include a model of an iPod® or iPhone® available from available from Apple Inc. of Cupertino, Calif. In other embodiments, the electronic device may include other models and/or types of electronic devices employing LED backlights, available from any manufacturer.

As illustrated in FIG. 1, electronic device 10 includes a housing 12 that supports and protects interior components, such as processors, circuitry, and controllers, among others, that may be used to generate images to display on display 14. Housing 12 also allows access to user input structures 16, 18, 20, and 22 that may be used to interact with electronic device 10. User input structures 40, 42, 44, and 46, in combination with the display 18, may allow a user to control the handheld device 34. For example, input structure 16 may activate or deactivate the handheld device 34; input structure 42 may activate a home screen, a user-configurable application screen, or a voice-recognition feature; input structures 20 may provide volume control, and input structure 22 may toggle between vibrate and ring modes. Electronic device 10 also includes a microphone 48 that receives voice data from a user, and a speaker 50 that enables audio playback or certain phone capabilities.

Further, user input structures 16, 18, 20, and 22 may be manipulated by a user to operate a graphical user interface (GUI) and/or applications running on electronic device 10. Moreover, in certain embodiments, electronic device 10 may include a touch screen, located in front of display 14, that allows the user to interact with electronic device 10. Electronic device 10 also may include input and output (I/O) ports 28 and 30 that allow connection of device 10 to external devices, such as headphones, external speakers, a power source, or other electronic device.

FIG. 2 is a block diagram illustrating various components and features of device 10. In addition to display 14, input structures 16, 18, 20, and 22, and I/O ports 28 and 30 discussed above, device 10 includes a processor 32 that may control operation of device 10. Processor 32 may use data from a storage 34 to execute the operating system, programs, GUI, and any other functions of device 10. Storage 24 may include non-transitory, computer readable media that stores instructions, programs, and/or code for execution by processor 32. Further, storage 24 may represent random-access memory, read-only memory, rewritable flash memory, hard drives, and optical discs, among others. Processor 32 also may receive data through I/O port 30 or through a network device 36, which may represent, for example, one or more network interface cards (NIC) or a network controller.

Information received through network device 36 and I/O port 30, as well as information contained in storage 34, may be displayed on display 14. Display 14 may generally include an LED backlight 38 that functions as a light source for an LCD panel 40 within display 14. As noted above, a user may select information to display by manipulating a GUI through user input structures 16, 18, 20, and 22, and a touch screen. In certain embodiments, a user may adjust properties of LED backlight 38, such as the color and/or brightness of the white point, by manipulating a GUI through user input structures 16, 18, 20, and 22 and the touch screen. An input/output (I/O) controller 42 may provide the infrastructure for exchanging data between input structures 16, 18, 20, and 22, I/O ports 28 and 30, display 14, and processor 32.

FIG. 3 is an exploded view of an embodiment of display 14 employing an edge-lit LED backlight 38. Display 14 includes backlight 38 and LCD panel 40, which may be assembled within a frame 44. LCD panel 40 may include an array of pixels configured to selectively modulate the amount and color of light passing from backlight 38 through LCD panel 40. For example, LCD panel 40 may include a liquid crystal layer, one or more thin film transistor (TFT) layers configured to control orientation of liquid crystals of the liquid crystal layer via an electric field, and polarizing films, which cooperate to enable LCD panel 40 to control the amount of light emitted by each pixel. LCD panel 40 may be a twisted nematic (TN) panel, an in-plane switching (IPS) panel, a fringe-field switching (FFS) panel, variants of the foregoing types of panels, or any other suitable panel.

Backlight 38 includes a light guide 46, such as a light guiding plate, one or more optical films 48, such as one or more brightness enhancement films, and a light source 50 that includes LEDs 52. Light from LEDs 52 is directed through light guide 46 and optical films 48 and generally emitted toward LCD panel 40. As shown in FIG. 3, backlight 38 is an edge-lit backlight that includes one light source 50 located at an edge of display 14. However, in other embodiments, multiple light sources 50 may be disposed around the edges of display 14. Further, in certain embodiments, instead of an edge-lit backlight, the backlight may be a direct-light backlight that has an array of LEDs mounted on an array tray behind the LCD panel.

LEDs 52 may be any type of LEDs designed to emit a white light. In certain embodiments, LEDs 52 may include phosphor based white LEDs, such as single color LEDs coated with a phosphor material, or other wavelength conversion material, to convert monochromatic light to broad-spectrum white light. For example, a blue die may be coated with a yellow phosphor material. In another example, a blue die may be coated with both a red phosphor material and a green phosphor material. The monochromatic light, for example, from the blue die, may excite the phosphor material to produce a complementary colored light that yields a white light upon mixing with the monochromatic light. LEDs 52 also may include multicolored dies packaged together in a single LED device to generate white light. For example, a red die, a green die, and a blue die may be packaged together, and the light outputs may be mixed to produce a white light. Further, LEDs 52 may include ultraviolet (UV) dies with a mix of red, green, blue, or yellow phosphor material.

Figure 4:
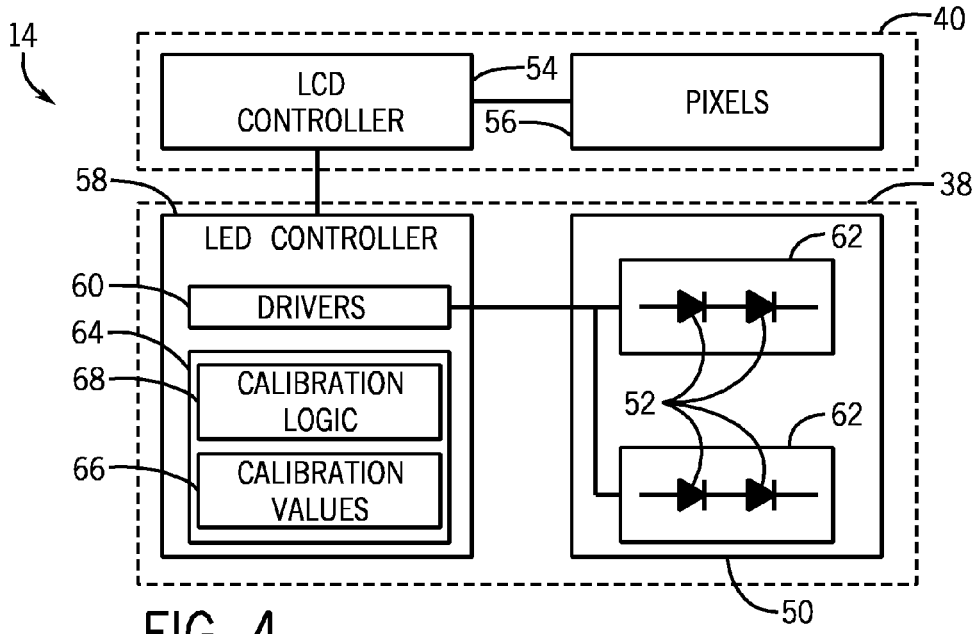
FIG. 4 is a block diagram of an example of components of an LCD display, in accordance with aspects of the present disclosure.

Additional details of illustrative display 14 may be better understood through reference to FIG. 4, which is a block diagram illustrating various components and features of display 14. Display 14 includes LCD panel 40 and LED backlight 38. LCD panel 40 includes an LCD controller 54 that governs operation of the LCD panel. For example, LCD controller 54 may include one or more driver integrated circuits that receive image data, for example, from a graphics card or controller of device 10, and output control signals to change the transmissive state of pixels 56 within LCD panel 40. According to certain embodiments, LCD controller 54 may be located on a driver ledge within the LCD panel 40, while the pixels 56 may be located within an active area of the LCD panel 40 that is visible to a user. Further, in certain embodiments, a flexible circuit (i.e. a flex cable) may be used to connect LCD controller 54 to the I/O controller 42 (FIG. 1) of electronic device 10.

LED backlight 38 includes an LED controller 58 that governs operation of light source 50. In particular, LED controller 58 includes one or more drivers 60 that power and drive strings 62 of LEDs 52 mounted within backlight 38. Each string 62 includes LEDs 52 that emit light of a similar color and/or brightness. Specifically, LEDs 52 may include groups of LEDs selected from different bins defining properties of the LEDs, such as color or chromaticity, flux, and/or forward voltage. LEDs 52 from the same bin may be joined together in one or more strings 62, with each string being independently driven by a separate driver 60 or driver channel. Each display 14 may have a target white point, represented by a set of chromaticity coordinates, tristimulus values, or the like. The same target white point may be used across similar devices, and each device may be calibrated to emit the target white point so that similar devices all emit a uniform white point.

Drivers 60 may include one or more integrated circuits that may be mounted on a printed circuit board and controlled by LED controller 58. In certain embodiments, drivers 60 may include multiple channels for independently driving multiple strings 52 of LEDs with one driver 60. Drivers 60 may include a current source, such as a transistor, that provides current to LEDs 62, for example, to the cathode end of each LED string. Further, the drivers 60 may include components, such as resistors, amplifiers, and field effect transistors, for regulating the current provided to LEDs 62. Drivers 60 also may include voltage regulators. In certain embodiments, the voltage regulators may be switching regulators, such as pulse width modulation (PWM) regulators.

LED controller 58 may set the driving strengths of drivers 60 to certain driving strengths that enable display 14 to emit the target white point. Specifically, LED controller 58 may send control signals to drivers 60 to vary the current and/or the duty cycle to LEDs 52. For example, LED controller 58 may provide forward current reference signals (e.g., in the form of control voltages) to drivers 60 to adjust the amount of current passing through strings 62. In another example, LED control 58 may vary the PWM duty cycle of drivers 60.

LED controller 58 may determine the driving strengths at which to set drivers 60 using information stored in memory 64. For example, LED controller 58 may use calibration values 66 stored in memory 64 in conjunction with calibration logic 68 to determine the driving strength for each driver 60, or driver channel. Calibration values 66 describe chromaticity and/or brightness properties of LED strings 62 that can be used to determine the driving strengths for producing the target white point. For example, according to certain embodiments, calibration values 66 may represent the chromaticities and/or brightness of each LED string 62 included within backlight 38. In another example, calibration values 66 may represent the chromaticity and/or brightness of mixed light emitted by the combination of LED strings 62. In yet another example, calibration values 66 may represent the deviation in each string from the target white point, or the deviation in the mixed light from the LED strings 62 from the target white point.

The calibration values 66 may be determined by independently testing the LED strings 62 prior to, or after, assembly of LED strings 62 within display 14, as discussed further below with respect to FIGS. 6-12. The chromaticities, or values based on the chromaticities, may then be stored in memory 64 as calibration values 66 that can be employed by LED controller 58 to calibrate the display 14 to emit the target white point. For example, in certain embodiments, a user may program the calibration values 66 into memory 64 during assembly of display 14. However, in other embodiments, a user may enter the calibration values 66 through a user interface of device 10, through an I/O port 30, or through a network connection.

LED controller 58 may then employ the calibration values 66 to determine the appropriate driving strengths for each LED string 62. For example, LED controller 58 may execute calibration logic 64 stored within memory 64 to determine the driving strengths, as discussed further below with respect to FIGS. 10 and 14. According to certain embodiments, calibration logic 64 may include hardware and/or software control algorithms or instructions that can be executed by LED controller 58 to determine the driving strengths based on calibration values 66. Further, in certain embodiments, LED controller 58 may employ calibration curves or tables stored in memory 64 in conjunction with calibration logic 64 to determine the driving strengths.

According to certain embodiments, memory 64 may be an EEPROM, flash memory, or other suitable optical, magnetic, or solid-state computer readable media. As shown in FIG. 4, memory 64 is included within backlight 38 as part of LED controller 58. However, in other embodiments, memory 64 may be a standalone component included within backlight 38. Further, in other embodiments, the calibration values 66 and calibration logic 68 may be stored within a memory of LCD panel 40, such as within a memory of LCD controller 54, or within a memory of electronic device 10, such as storage 34 (FIG. 2).

After determining the driving strengths, LED controller 58 may then adjust drivers 60 to operate at the determined driving strengths. According to certain embodiments, LED controller 58 may store the determined driving strengths in memory 64, as base driving strengths that can be employed throughout the operation life of backlight 38. For example, the chromaticity and brightness of the LEDs 52 may shift over time due to aging or changes in temperature. In certain embodiments, LED controller 58 may be designed to compensate for these shifts by adjusting the driving strength of drivers 60. In these embodiments, LED controller 58 may use the base driving strengths as a starting point for future driving strength adjustments.

Figure 5:
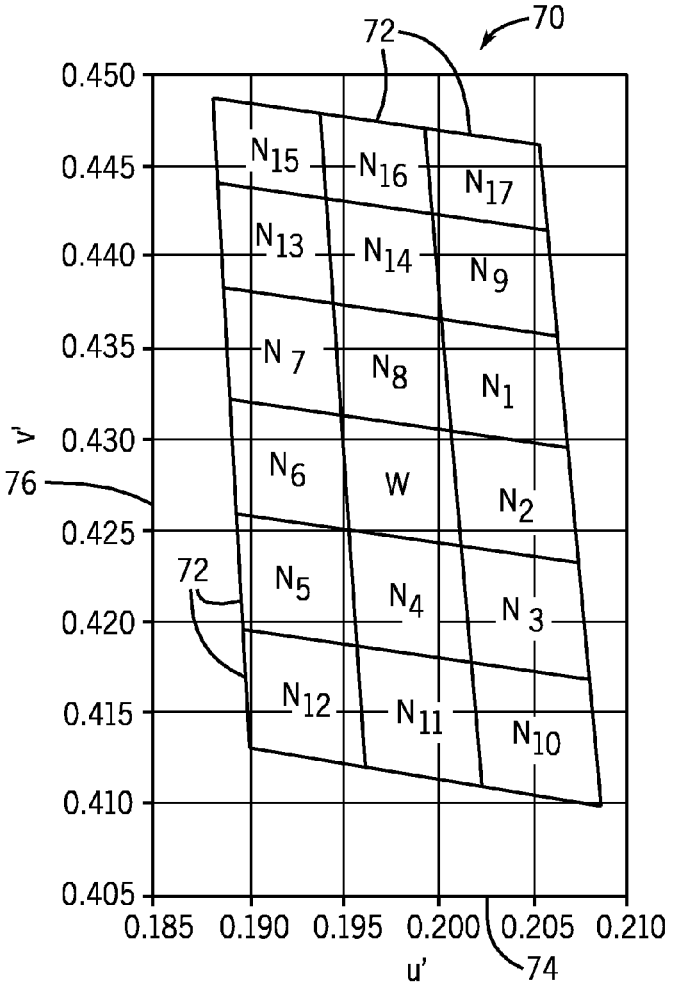
FIG. 5 is a diagram illustrating LED bins, in accordance with aspects of the present disclosure.

As described above with respect to FIG. 4, LEDs 52 may be selected from multiple bins, with each bin defining color and/or brightness properties of the LEDs, such as color, brightness, forward voltage, flux, and tint, among others. FIG. 5 illustrates a representative LED bin chart 70, such as from a commercial LED manufacturer, that may be used to group LEDs into bins 72, with each bin of LEDs exhibiting a different white point. Bin chart 70 may generally plot chromaticity values, describing color as seen by a standard observer, on x and y axes 74 and 76. For example, bin chart 70 may use chromaticity coordinates corresponding to the CIE 1976 UCS chromaticity diagram developed by the International Commission on Illumination (CIE). On bin chart 70, x-axis 74 may plot the u' chromaticity coordinates, which may generally progress from blue to red along x-axis 74, and y-axis 76 may plot the v' chromaticity values, which may generally progress from blue to green along y-axis 76. However, in other embodiments, LEDs 52 may be selected from bins represented by other chromaticity diagrams, such as the CIE 1931 chromaticity diagram, which plots the x and y chromaticity coordinates.

Each bin represents different chromaticities, and LEDs may be selected from different bins so that when light from the LEDs mixes, a chromaticity close to the target white point is produced. The center bin W may encompass chromaticity values corresponding to the target white point, while the surrounding bins $N_{1-17}$ may encompass chromaticity values which are further from the target white point. According to certain embodiments, LEDs may be selected from the neighboring bins $N_{1-17}$ on opposite sides of center bin W so that when the light from each of the LEDs 52 is mixed, the emitted light may closely match the target white point. For example, as shown on chart 70, bin W may encompass the target white point. A backlight employing all bin W LEDs may substantially match the target white point. However, manufacturing costs may be reduced if a larger number of bins are used within a backlight. Accordingly, LEDs from neighboring bins $N_{1-17}$, for example, may be employed within the backlight. The LEDs from the neighboring bins $N_{1-17}$ may be selectively positioned within the backlight to produce an output close to the target white point. For example, the LEDs from neighboring bins may be staggered or arranged sequentially throughout backlight 38. The LEDs from the same bin may be joined on separate strings, so that the driving strength of LEDs from different bins may be independently adjusted to align the emitted light with the target white point.

In certain embodiments, LEDs from two or more neighboring bins $N_{1-17}$ may be selected and mixed within an LED backlight. For example, a backlight may employ LEDs from complementary bins $N_2$ and $N_6$; complementary bins $N_1$ and $N_5$; or complementary bins $N_5$, $N_3$, and $N_8$. Moreover, LEDs from the target white point bin W and from the neighboring bins $N_{1-12}$ may be mixed to yield the desired white point. For example, a backlight may employ LEDs from bins W, $N_6$, and $N_2$. In another example, a backlight may employ multiple strings of LEDs selected from bin W. As may be appreciated, any suitable combination of bins may be employed within a backlight. Further, a wider range of bins than is shown may be employed.

Figure 6:
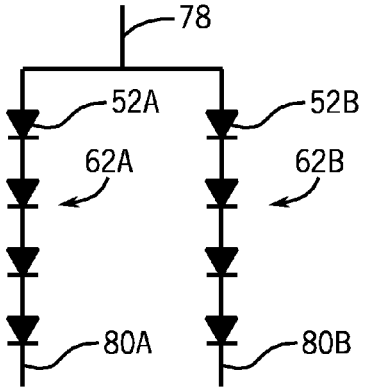
FIG. 6 is a schematic diagram of an example of LED strings that may be employed in an LED backlight, in accordance with aspects of the present disclosure.

FIG. 6 depicts two LED strings 62A and 62B that may be employed in backlight 38. String 62A includes LEDs 52A from bin $N_1$, and string 62B includes LEDs 52B from bin $N_5$. As shown, the strings 62A and 62B are arranged in parallel, extend from a shared anode, and terminate at separate cathodes 80A and 80B. However, in other embodiments, strings 62A and 62B may each have separate anodes and cathodes. Further, as shown in FIG. 6, each string 62A and 62B includes four LEDS 52A and 52B, respectively. However, in other embodiments, any number of LEDs may be included on each string.

Each string 62A and 62B may be tested separately to determine its chromaticity. For example, string 62A may be driven at a base current, such as 20 mA, while no current is directed to string 62B. Similarly, string 62B may be driven at the base current, while not current is direct to string 62A. Optical sensors, such as phototransistors, photodiodes, or photoresistors, among others, can then be employed to detect the chromaticity of each string 62A and 62B. Further, in certain embodiments, optical sensors may be employed to detect the chromaticity of the mixed light produced by operating both strings 62A and 62B. However, in other embodiments, the chromaticity of the mixed light from strings 62A and 62B, referred to as the "mixed chromaticity," may be calculated from the individual chromaticities of strings 62A and 62B.

Figure 7:
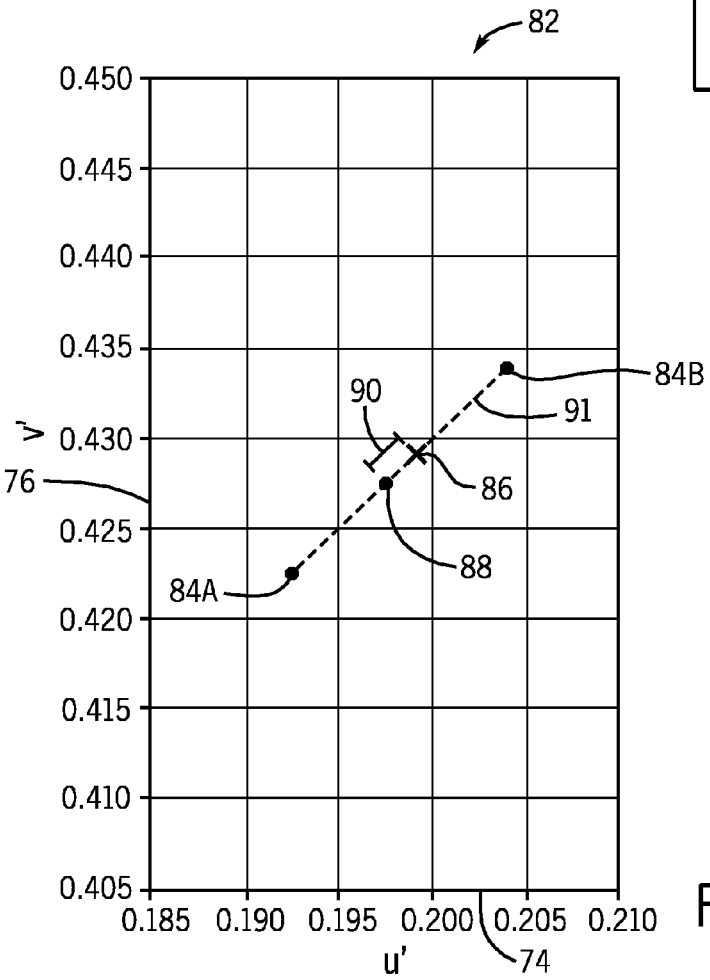
FIG. 7 is a chart depicting the base chromaticity values of the LED strings of FIG. 6, as well as the target white point, in accordance with aspects of the present disclosure.

FIG. 7 is a chart 82 depicting the chromaticities 84A and 84B of strings 62A and 62B, respectively. As discussed above, the chromaticities 84A and 84B may be determined by driving strings 62A and 62B, respectively, at the base current and measuring the emitted chromaticity with optical sensors. The chromaticities 84A and 84B may be represented by the u' and v' coordinates, shown on the x and y axes 74 and 76, respectively. The target white point 88 lies generally on a line 91 between chromaticities 84A and 84B. The chromaticity 86 of the mixed light from strings 62A and 62B also lies generally on line 91. As may be appreciated, the chromaticity of the mixed light may be adjusted to any chromaticity on line 91 by varying the driving strengths of the LED strings.

As shown by chart 82, the mixed chromaticity 86 deviates from the target white point 88 by an amount 90. However, as discussed further below with respect to FIGS. 9-10, the driving strengths of strings 62A and 62B can be adjusted to align mixed chromaticity 86 with the target white point 88. For example, since chromaticity 84A is closer to the target white point 88, the driving strength of string 62A may be increased, relative to the driving strength of string 62B, to bring the mixed chromaticity 86 closer to the target white point 88. As the current through the strings 62A and 62B increases, the overall brightness of backlight 38 also may increase. Accordingly, the ratio of the driving strengths may be adjusted, rather than just increasing the driving strength of one string 62A or 62B, to align the mixed chromaticity 86 with the target white point 88 while maintaining a relatively constant brightness.

Figure 8:
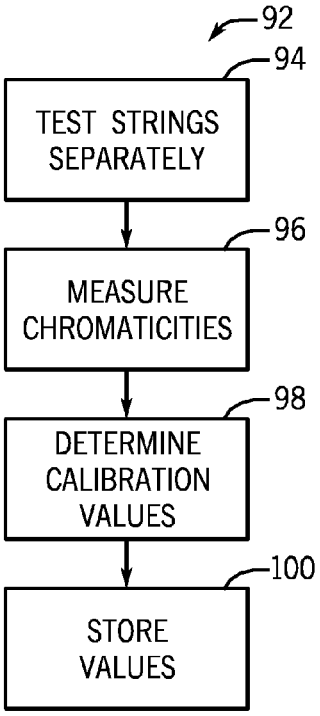
FIG. 8 is a flowchart depicting a method for setting calibration values for an LCD display, in accordance with aspects of the present disclosure.

FIG. 8 depicts a flowchart of a method 92 for calibrating a display to emit the target white point. Method 92 may begin by testing (block 94) each LED string in isolation that may be included in the backlight. For example, as described above with respect to FIG. 6, the base current may be applied to each LED string 62 in a sequential manner to individually drive each string 62, while no current is provided to the other strings. As each string is tested, the chromaticity of each string may be measured (block 96) using one or more optical sensors. According to certain embodiments, each string 62 may be tested after the string is installed within display 14. Accordingly, the measured chromaticities may account for white point shifts that may be introduced by display components, such as the backlight diffuser and thin film transistor layers included within LCD panel 40. However, in other embodiments, the strings 62 may be tested prior to installation in the display.

The measured chromaticity values may then be used to determine (block 98) the calibration values. According to certain embodiments, the calibration values may correspond to the measured chromaticity values. For example, as shown in FIG. 7, the u' and v' coordinates of chromaticity values 84A and 84B may be used as the calibration values. In another example, the u' and v' coordinates of the mixed chromaticity 86 may be used as the calibration values. In this example, additional information, such as the LED bins used in each string may be included as part of the calibration values. In a further example, the magnitude and direction of the amount 90 of deviation from the target white point 88 may be used as the calibration values. Further, any combination of the preceding information may be used as the calibration values.

The calibration values may then be stored (block 100) within the display. For example, as described above with respect to FIG. 4, the calibration values 66 may be stored within a memory 64 of the LED controller 58 for the backlight 38. Further, calibration logic 64 for using the calibration values 66 to produce the target white point also may be stored within the memory 64. Moreover, in other embodiments, the calibration values 66 may be stored within other parts of device 10, such as within LCD panel 40 or storage 34 (FIG. 1).

Figure 9:
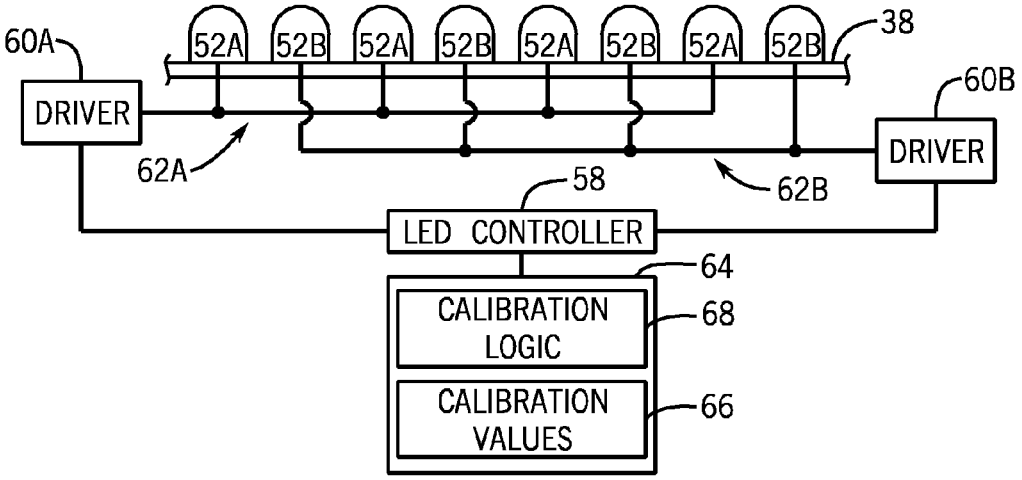
FIG. 9 is a schematic diagram illustrating operation of an embodiment of the LED backlight of FIG. 3, in accordance with aspects of the present disclosure.

FIG. 9 is a schematic diagram illustrating operation of LED backlight 38. The LEDs 52A and 52B from strings 62A and 62B, respectively, are alternated between one another. Each string 62A and 62B is driven by a separate driver 60A and 60B, each of which is communicatively coupled to LED controller 58. As discussed further below with respect to FIG. 10, LED controller 58 may employ calibration logic 68 to determine the driving strength for each driver 60A and 60B based on the calibration values 66. LED controller 58 may then transmit control signals to set the driving strength of each driver 60A and 60B to the determined driving strength. For example, LED controller 58 may transmit control voltages to drivers 60A and 60B to vary the forward current applied to each LED string 62A and 62B. In another example, LED controller 58 may vary the duty cycles of drivers 60A and 60B.

Figure 10:
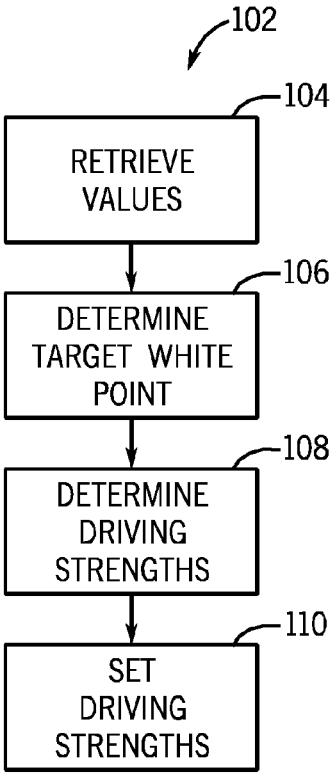
FIG. 10 is a flowchart depicting a method for calibrating the display of FIG. 3 to a target white point, in accordance with aspects of the present disclosure.

FIG. 10 is a flowchart depicting a method 102 for determining and setting the driving strength of each driver 60A and 60B to produce the target white point. Method 102 may begin by retrieving (block 104) the calibration values. For example, LED controller 58 may retrieve the calibration values 66 from memory 64. In another example, LED controller 58 may retrieve the calibration values from storage 34 (FIG. 1) or from LCD controller 54. The LED controller may then determine (block 106) the target white point. In certain embodiments, the target white point may be stored within memory 64 as part of the calibration values 66. In these embodiments, the LED controller 58 may retrieve the target white point as part of the calibration values 66. However, in other embodiments, the LED controller 58 may retrieve the target white point from the storage 34 (FIG. 1) or from the LCD controller 54 (FIG. 4).

LED controller 58 may then determine (block 108) the driving strengths for the LED strings included within the backlight. In particular, LED controller 58 may use the calibration logic 68 to calculate the driving strengths based on the calibration values 66. For example, in embodiments where the calibration values 66 represent the chromaticities of each string of LEDs, LED controller 58 may employ the calibration logic 68 to determine the ratios that should exist between the driving strengths to produce the target white point. According to certain embodiments, LED controller 58 may determine the deviation in the chromaticity for each string of LEDs from the target white point and calculate the driving strength ratios based on the deviations. After determining the ratios, LED controller 58 may scale the driving strengths for each string of LEDs to produce the desired ratios.

In another example, in embodiments where the calibration values 66 represent the mixed chromaticity, LED controller 58 may employ the calibration logic 68 to compare the mixed chromaticity to the target white point and determine the amount of driving strength adjustment that should produce the target white point. In a further example, in embodiments where the calibration values 66 represent the magnitude and direction of deviation in the mixed chromaticity from the target white point, LED controller 58 also may employ the calibration logic to determine the driving strength adjustments that should produce the target white point. LED controller 58 may then apply the driving strength adjustments to the default driving strength settings for each driver 60 to determine the specific driving strengths.

After determining the driving strengths, the LED controller 58 may then set (block 110) the drivers 60 to the determined driving strengths. For example, the LED controller 58 may transmit control signals to the drivers 60 to adjust the amount of forward current applied to the LED strings. In another embodiment, LED controller 58 may transmit control signals to drivers 60 to vary the PWM duty cycle.

Figure 11:
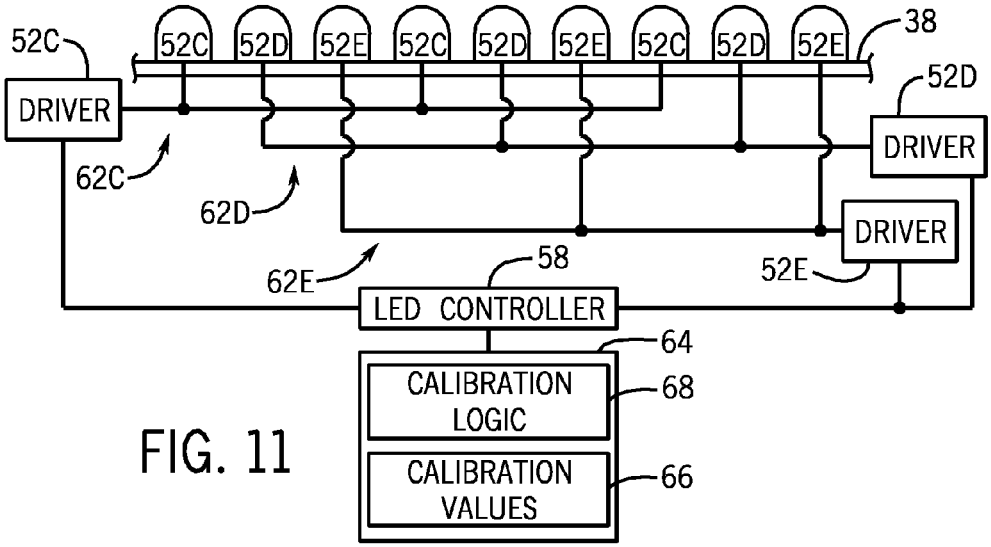
FIG. 11 is a schematic diagram illustrating operation of another embodiment of the LED backlight of FIG. 3, in accordance with aspects of the present disclosure.

Although methods 92 and 102, shown in FIGS. 8 and 10, respectively, have been described above in the context of a backlight that employs two strings of LEDs, these methods also may be employed in backlights employing three or more strings of LED. FIG. 11 depicts an embodiment of a backlight that employs three LED strings 62C, 62D, and 62E. Each string 62C, 62D, and 62E employs LEDs 52C, 52D, and 52E from a different bin. For example, LEDs 52C may be from bin $N_5$, LEDs 52D may be from bin $N_2$, and LEDs 52E may be from bin $N_8$. The LEDs 52C, 52D, and 52E are alternated sequentially along backlight 38.

Each string 62C, 62D, and 62 is driven by a separate driver 60C, 60D, and 60E, each of which is communicatively coupled to LED controller 58. The backlight may be assembled using method 92 described above with respect to FIG. 8, and calibration values representing the chromaticity of each string 62C, 62D, and 62E may be stored within memory 64. As discussed above with respect to FIG. 10, LED controller 58 may employ calibration logic 68 to determine the driving strength for each driver 60C, 60D, and 60E based on the calibration values 66. LED controller 58 may then transmit control signals to set the driving strength of each driver 60C, 60D, and 60E to the determined driving strength.

Figure 12:
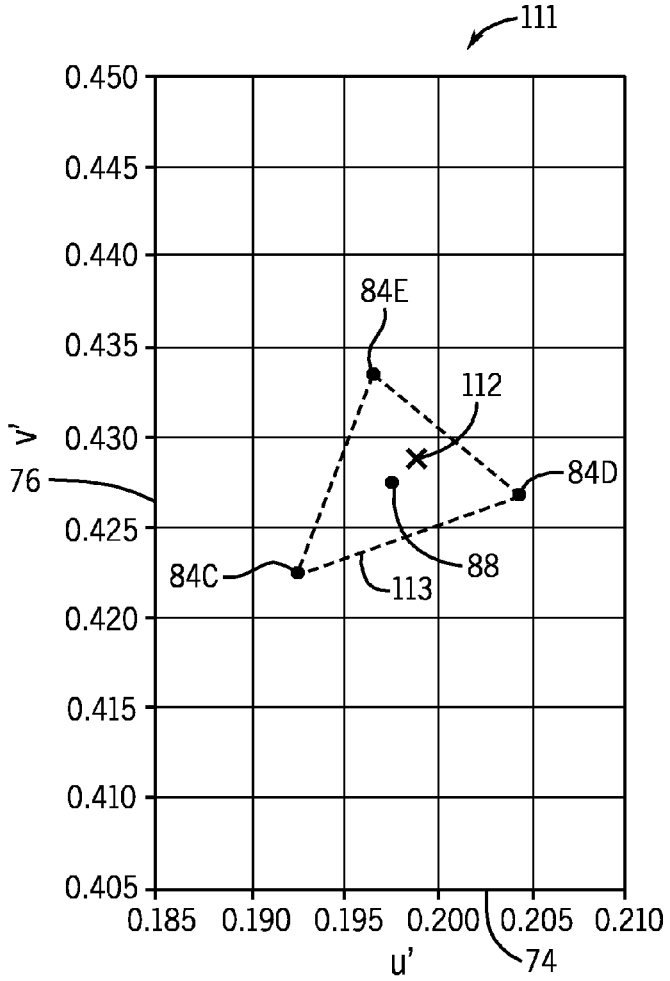
FIG. 12 is a chart depicting the base chromaticity values of the LED strings employed in the backlight of FIG. 11, in accordance with aspects of the present disclosure.

FIG. 12 is a chart 111 depicting the chromaticities 84C, 84D, and 84E of strings 62C, 62D, and 62E, respectively, when the strings are driven at the base current. As shown by chart 111, the target white point 88 lies within a triangle 113 formed by the chromaticities 84C, 84D, and 84E. By varying the driving strengths of strings 62C, 62D, and 62E, the mixed chromaticity may be adjusted to any chromaticity encompassed by triangle 113. Accordingly, employing three strings of LEDs may allow a greater range of adjustment in the mixed chromaticity. At the base current, the mixed chromaticity 112 lies slightly above and to the right of the target white point 88. However, method 102 may be employed as described above with respect to FIG. 10 to adjust the driving strengths so that the mixed chromaticity matches the target white point.

Figure 13:
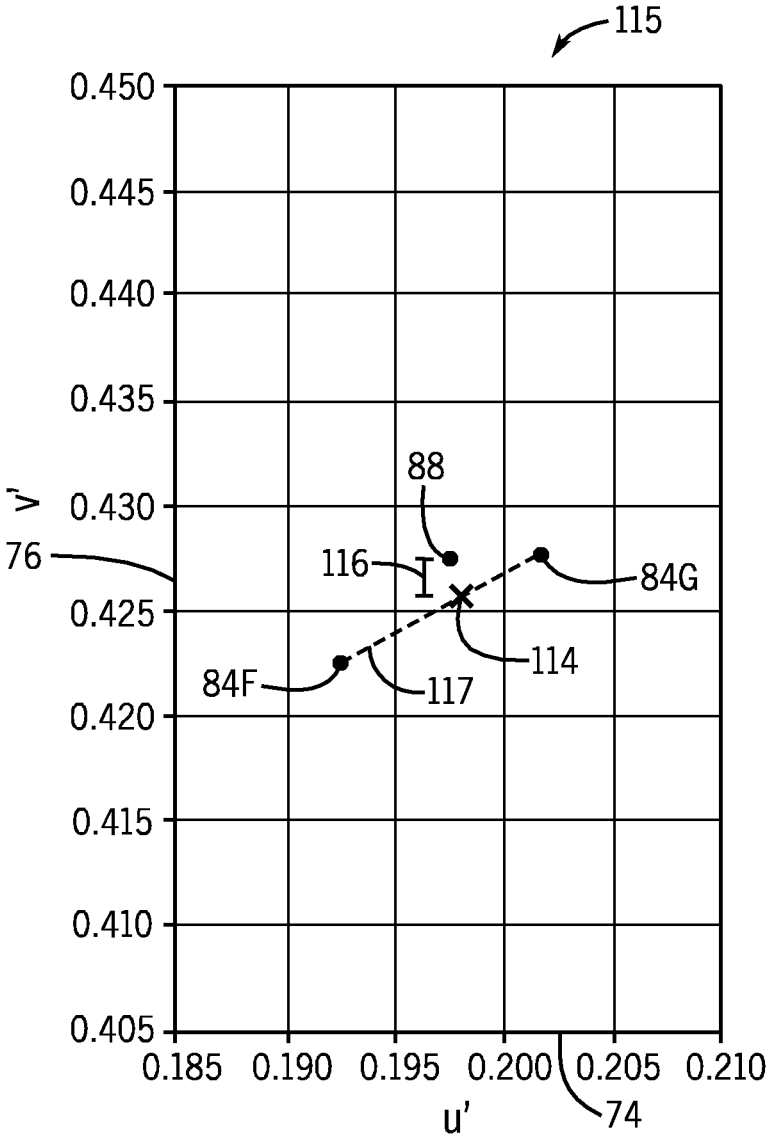
FIG. 13 is a chart depicting the base chromaticity values of embodiments of LED strings that may be employed in an LED backlight, in accordance with aspects of the present disclosure.
Figure 14:
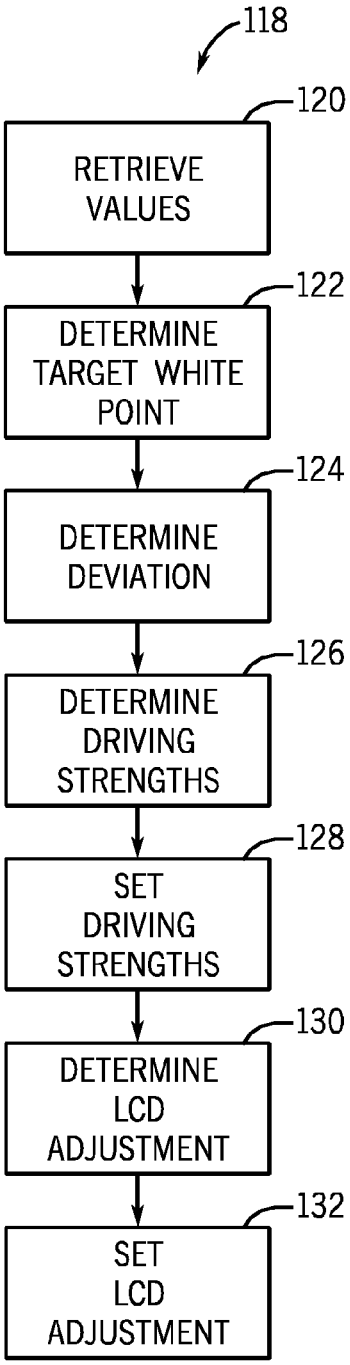
FIG. 14 is a flowchart depicting a method for calibrating a display employing the LED strings of FIG. 13, in accordance with aspects of the present disclosure.
Figure 15:
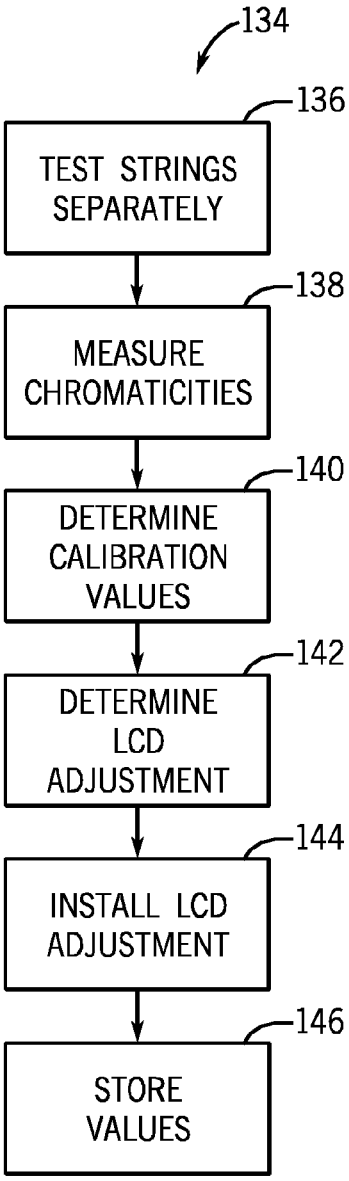
FIG. 15 is a flowchart depicting a method for assembling a display employing the LED strings of FIG. 13, in accordance with aspects of the present disclosure.

FIGS. 7-12 depict embodiments where the driving strengths of LED strings within the backlight may be adjusted to produce the target white point. However, in certain embodiments, the LCD panel also may be adjusted to produce the target white point for the display. In particular, FIGS. 13-15 depict embodiments where LCD panel adjustments may be employed in addition to driving strengths adjustments in the backlight. The LCD panel adjustments may be particularly beneficial where additional adjustments are desired in addition to those that can be achieved by varying the LED driving strengths. The LCD panel adjustments also may be beneficial where the LED driving strength adjustments by themselves may produce less desirable results, such as a display that may be too dim.

FIG. 13 is a chart 115 depicting the chromaticities 84F and 84G of two different LED strings, when the strings are driven at the base current. As shown by chart 115, the mixed chromaticity 114 lies on a line 117 that extends between chromaticities 84F and 84G. As may be appreciated, the mixed chromaticity may be adjusted to any chromaticity that lies generally along line 117 by adjusting the driving strengths of the LED strings. However, target white point 88 lies above line 117 by a distance 116. Accordingly, additional adjustments may be desired to produce the target white point on display 14. As discussed further below, the additional adjustment may be provided through hardware and/or software modifications to LCD panel 44.

FIG. 14 is a flowchart of a method 118 for adjusting the emitted white point by modifying operation of the LCD panel 44. Method 118 may begin by retrieving (block 120) calibration values and by determining (block 122) the target white point, in a manner as described above with respect to blocks 104 and 106 of FIG. 10. For example, the calibration values and the target white point may be retrieved from memory 64 (FIG. 11), storage 34 (FIG. 1), or from LCD panel 44. The LCD controller 58 may then determine (block 124) the deviation of the mixed chromaticity from the target white point. For example, as shown in FIG. 13, LED controller 58 may employ calibration logic 68 to determine the chromaticity difference between the mixed chromaticity 114 and the target white point 88.

LED controller 58 may then determine (block 126) the driving strengths for the respective LED strings that will more closely align the mixed chromaticity 114 with the target white point 88. The driving strengths may generally be determined as described above with respect to block 108 of FIG. 10. However, rather than determining the driving strengths that will align the mixed chromaticity with the target white point 88, the LED controller 58 may determine the driving strengths that will bring the mixed chromaticity closes to the target white point 88. In other words, in this embodiment, while the driving strength adjustments may allow the mixed chromaticity to approach the target white point, further adjustment may be desired to align the mixed chromaticity with the target white point. LCD controller 58 may then set (block 128) the drivers 60 to the determined driving strengths. For example, the LED controller 58 may transmit control signals to the drivers 60 to adjust the current or duty cycles of the drivers 60, as described above with respect to block 110 of FIG. 10.

LED controller 58 may then determine (130) the LCD adjustment required to align the mixed chromaticity with the target white point. For example, LED controller 58 may determine a gamma correction that should be applied to pixels 56 (FIG. 4) of LCD panel 14. In particular, LED controller 58 may determine the amount and type of gamma correction. In the illustrated embodiment, the target white point 88 lies above the mixed chromaticity in the green direction, as shown in FIG. 13. Accordingly, LED controller 58 may employ the calibration logic 64 to determine that LCD panel 40 should be shifted in the green direction. However, in other embodiments, depending on the difference between the mixed chromaticity and the target white point, the LCD panel 40 may be shifted in the red or blue direction.

LED controller 58 may then set (block 132) the LCD adjustment. For example, LED controller 58 may transmit a control signal to LCD controller 54 (FIG. 4) that indicates the type and amount of gamma correction. LCD controller 54 may then perform the gamma correction. For example, in the illustrated embodiment, LCD controller 54 may increase the voltage for the green pixels. However, in other embodiments, LCD controller 54 may adjust the voltage for the green pixels, the red pixels, and/or the blue pixels depending on the type of adjustment that is desired. For example, the voltage of the green pixels may be increased so that these pixels are brighter than the red and blue pixels, which in turn shifts the white point in the green direction. Further, in certain embodiments, the ratios of the voltages between the red, green, and blue pixels may be adjusted to shift the white point while maintaining a constant brightness. Moreover, in other embodiments, LED controller 58 may operate in conjunction with LCD controller 54 to determine (block 130) the LCD adjustment. For example, in certain embodiments, LCD controller 54 may determine the type and amount of gamma correction that should be employed based on data received from LED controller 58.

FIG. 15 is a flowchart depicting a method 134 for assembling a backlight where a hardware adjustment may be made to the LCD panel to allow the backlight to be calibrated to the target white point. Method 134 may begin by testing (block 136) each string separately, measuring (block 138) the chromaticity for each string, and determining (block 140) the calibration values, in a manner as described above with respect to blocks 94, 96, and 98 of FIG. 8. Method 134 may then continue by determining (block 142) an LCD hardware adjustment that will allow the mixed chromaticity to align with the target white point. For example, a technician may determine the range of chromaticity adjustments that can be achieved by varying the driving strengths of the LED strings to allow the mixed chromaticity to approach the target white point. The technician may then determine a direction and amount of additional adjustment that is needed to allow the mixed chromaticity to align with the target white point. For example, as shown in FIG. 13, a technician may determine that the line 117 connecting the measured chromaticities lies a distance 116 below the target white point. The technician may then identify an LCD adjustment that can compensate for the distance 116 from the target white point. According to certain embodiments, the LCD adjustment may include shaping a color mask around red, green, or blue pixels, including a more reflective layer around red, green, or blue pixels, including a greater number of red, green, or blue pixels in LCD panel 40, or applying a voltage setting. The calibration values may then be stored (block 146), in a manner similar to that described above with respect to block 100 of FIG. 8.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A display, comprising:

a first string of first light emitting diodes;

a second string of second light emitting diodes;

a storage containing calibration values representing a first emitted chromaticity of the first string when driven at a base current in isolation and a second emitted chromaticity of the second string when driven at the base current in isolation; and a controller configured to determine a first driving strength for the first string and a second driving strength for the second string based on the calibration values, wherein the calibration values comprise a first set of chromaticity coordinates representing the first emitted chromaticity and a second set of chromaticity coordinates representing the second emitted chromaticity.

2. A display, comprising:

a first string of first light emitting diodes;

a second string of second light emitting diodes;

a storage containing calibration values representing a first emitted chromaticity of the first string when driven at a base current in isolation and a second emitted chromaticity of the second string when driven at the base current in isolation; and a controller configured to determine a first driving strength for the first string and a second driving strength for the second string based on the calibration values, wherein the calibration values comprise a set of chromaticity coordinates representing a mixed chromaticity of the first emitted chromaticity and the second emitted chromaticity.

3. A method, comprising:

storing, in a storage of an electronic device comprising a backlight, calibration values representing emitted chromaticities for each of a plurality of strings of light emitting diodes driven at a base current in isolation; and configuring a controller of the electronic device to determine individual driving strengths for each of the plurality of strings based on the calibration values, wherein the individual driving strengths are configured to align a mixed chromaticity for the plurality of strings with a target white point, wherein storing calibration values comprises storing sets of chromaticity coordinates and brightness values for each of the emitted chromaticities.

* * * * *